US007012057B2

(12) United States Patent
Kapoor et al.

(10) Patent No.: US 7,012,057 B2
(45) Date of Patent: Mar. 14, 2006

(54) DETERGENT BARS COMPRISING RADIATION CURABLE RESINS

(75) Inventors: Bir Kapoor, Mumbai (IN); Samiran Mahapatra, Mumbai (IN); Kamsu Venkatasatyanarayana Murthy, Mumbai (IN)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 47 days.

(21) Appl. No.: 10/496,894

(22) PCT Filed: Oct. 28, 2002

(86) PCT No.: PCT/EP02/12035

§ 371 (c)(1),
(2), (4) Date: May 25, 2004

(87) PCT Pub. No.: WO03/046119

PCT Pub. Date: Jun. 5, 2003

(65) Prior Publication Data

US 2005/0014666 A1 Jan. 20, 2005

(30) Foreign Application Priority Data

Nov. 27, 2001 (IN) ..... 1131/MUM/01

(51) Int. Cl.
*C11D 17/00* (2006.01)

(52) U.S. Cl. ..... 510/440; 510/441; 510/442; 510/447; 510/475; 510/476; 427/487

(58) Field of Classification Search ..... None
See application file for complete search history.

(56) References Cited

U.S. PATENT DOCUMENTS

| | | | | |
|---|---|---|---|---|
| 3,383,320 | A * | 5/1968 | Bell, Jr. | 510/143 |
| 5,213,875 | A | 5/1993 | Su et al. | |
| 6,284,835 | B1 | 9/2001 | Ellison et al. | |
| 6,293,287 | B1 | 9/2001 | Anglin et al. | |

* cited by examiner

*Primary Examiner*—Necholus Ogden
(74) *Attorney, Agent, or Firm*—Ronald A. Koatz

(57) ABSTRACT

The invention concerns solid shaped detergent compositions comprising 0.5–95% by weight detergent active and 0–90% by weight of inorganic particulates and/or other conventional ingredients and wherein the external surface of said shaped detergent composition comprises at least one polymer film obtained by radiation curing or a radiation-curable resin composition.

4 Claims, No Drawings

DETERGENT BARS COMPRISING RADIATION CURABLE RESINS

TECHNICAL FIELD

The invention relates to shaped solid detergent compositions for cleaning hard surfaces or fabric or for personal wash and more particularly to compositions that have improved durability and thus retain shape although in continuous contact with water.

BACKGROUND AND PRIOR ART

Detergent compositions for fabric or hard surface cleaning typically comprise a surfactant system whose role is to assist in removal of soil. For fabric and hard surface cleaning, the surfactant system is often composed predominantly of non-soap surfactants.

Detergent compositions in the solid form are much cheaper than liquids because of low cost packaging and these are very popular forms for developing countries. The product dosage in the solid form is easier, it avoids spillage and the product application can be better controlled. Amongst the solid form, bars are gaining popularity and growing rapidly in the developing markets because of better value delivery. Cleaning compositions in the bar form are economically superior to other product forms and the dosage per swipe from the bar is highly controlled.

Detergent bars require an acceptable physical strength so that they retain their structural integrity during handling, transport and use. Various abrasives, fillers, builders, and other ingredients such as colour, perfume, preservatives, etc. may also be incorporated suitably.

Detergent bars for fabric and hard surface cleaning are in constant contact with water during usage and often during subsequent storage as well and hence get sogged and generally disintegrate to paste form. The shape and contour of the bars is not retained satisfactorily.

This problem is generally attempted to be solved by making suitable changes in the formulation of the bar. Any attempt to harden the bar, if not properly controlled through formulation, can result into a too hard product that would not release sufficient product for cleaning. Therefore, it is a major challenge to ensure that a) there is no disintegration of the product during use, b) there is no wastage of product through mush generation, and c) yet the product is sufficiently soft to enable the user to pick up the right quantity of product while cleaning.

In our co-pending application 417/Mum/2001, we have described a direct application, shaped detergent product which comprises a water-resistant coating that is capable of being abraded from the detergent product during use. Preferably, the shaped detergent product is an extruded bar and comprises an abrasive, wherein the external surface of the said detergent bar comprises one or more materials having a permeability coefficient for water less than $$1000\times10^{-13}\cdot\frac{[Cm^3][Cm]}{[Cm^2][s][Pa]}$$

and with a melting point greater than 30° C., wherein $[Cm^3]=Cm^3(273, 15K; 1{,}013\times10^5\ Pa.)$, as outlined in "Polymer Handbook, 1989, Third edition, Eds. J. Brandrup and E. H. Immergut, (Wiley-Interscience Publication), page VI/436".

Polymer coatings for protecting surfaces are known in literature. Polymer coating can be achieved by melt coating, solvent coating or radiation or thermal curing of liquid coating.

Radiation cured polymer films are known in the art and provide fast curing. Polymer film properties can be controlled by adjusting the polymer composition. Such coatings are amenable to various types of application methodology including spray, dip and brush coating.

Thus, photo-curable resin compositions (U.S. Pat. No. 5,213,875, Westinghouse, 1993), are used as topcoats on various objects and are formulated to provide scratch resistance, abrasion resistance, stain resistance, thermal stability, chemical and weather resistance to the coated object.

U.S. Pat. No. 6,284,835 (Lilly Indus. 2001), teaches curable coatings that exhibit high resistance to impact damage and are specifically applicable to sporting goods and equipment such as golf balls, vehicle bumpers and other surfaces.

U.S. Pat. No. 6,293,287 (Gillette, 2001) discloses the method of producing dental floss coated with a UV-cured resin to provide improved abrasion resistance.

However, none of the prior art teaches the use of these radiation curable resins to improve the durability of articles such as detergent compositions or other objects that are in continuous contact with water.

SUMMARY OF THE INVENTION

It is the basic objective of the present invention to provide selected polymer coatings or films on solid shaped detergent compositions, such as detergent bars or tablets for laundry and fabric washing, for hard surface cleaning and for personal cleansing and the like, which polymer coatings can be obtained by radiation curing of a radiation curable resin which can be readily applied, the polymer coating to provide desired gloss/surface finish and at the same time improve the durability of the detergent bars, even when in prolonged contact with water.

It is another object of the invention to provide selected polymer coatings for such detergent compositions which have proper adhesion to the surface of the compositions, which are of defined thickness and have good mechanical properties.

Yet another object of the present invention is to provide solid shaped detergent compositions such as bars and tablets (hereinafter collectively referred to as "detergent bars") which are coated with selected radiation curable polymer coatings or films with good adhesive properties to the bar surface, with desired thickness and with good mechanical properties, thereby causing the bar to maintain desired physical shape and integrity even in contact with water.

Yet another object is to provide polymer coated detergent bars which can be obtained by way of fast curing of a radiation curable resin applied to the surface of the bar, resulting in high through-put rates during manufacture.

Furthermore, it is an object of the present invention to provide a process for obtaining the detergent bars as described above.

DETAILED DESCRIPTION OF THE INVENTION

Thus according to the basic aspect of the present invention there is provided a solid shaped detergent composition (hereinafter referred to as "detergent bar") comprising:

0.5–95% by weight detergent active

0–90% by weight inorganic particulates and/or other optional conventional ingredients, wherein the external surface of said shaped detergent composition comprises at least one polymer coating or film obtained by radiation curing or a radiation-curable resin.

The detergent bars provided with the radiation cured film according to the invention are firm and yet are sufficiently soft to enable the user to pick up right quantity of detergent material from the bar while cleaning dishes or other hard surfaces or fabric or cleansing the skin and the coating is water-resistant, and is capable of being abraded from the bar during use.

The water-resistant coating film provided on the bar reduces disintegration and deformation of the shape during use and also reduces wastage of detergent by reducing mush formation. The water-resistant film is inherent on the bar surface and although it gets abraded along with the detergent during usage it is capable of maintaining the shape integrity of the bar. The water-resistant coating is preferably substantially insoluble in water, even under alkaline conditions.

According to one aspect of the present invention detergent bars according to the invention which are suitable for washing fabric or for cleaning hard surfaces including dishes and cooking utensils, preferably comprise:

0.5–60% by wt. detergent active,

10–90% by wt. inorganic particulate matter and other conventional ingredients, wherein the external surface of the said shaped detergent article comprises at least one polymer film made by radiation curing of a radiation-curable resin composition.

Detergent bars for laundry or fabric washing or for cleaning hard surfaces preferably comprise at least 2% by weight, preferably at least 5% of detergent active. Also they preferably comprise at least 10% wt of water-insoluble inorganic particulate matter which may act as filler, structurant, abrasive or any combination of these.

According to another aspect of the present invention detergent bars according to the invention which are suitable for personal cleansing (personal wash) preferably comprise 20–95% by wt detergent active and optionally up to 75% of inorganic particulates and/or other conventional ingredients, wherein the external surface of the said shaped detergent article comprises at least one polymer film formed by radiation curing of a radiation-curable resin. More preferably such personal wash bars comprise at least 40%, even more preferably at least 60% by weight of detergent active, whereas the amount of detergent active preferably does not exceed 90%. The total amount of inorganic particulates and other conventional ingredients generally does not exceed 40% by weight. In some particular embodiments the personal wash bars do not contain any inorganic particulate matter.

Thus, according to one preferred embodiment of the invention the coated detergent bars contain 60–95% wt of detergent active, more preferably, 60–90%.

Detergent bars according to the invention will generally contain at least 5% wt of water and preferably at least 10% or even 15% or more.

The said radiation-cured polymer could be generated using cationic and/or free-radical curing systems. The former can be formulated using cycloaliphatic compounds or silicones while the latter can be formulated using wide range of acrylates. These acrylates may be chosen from mono or multi functional acrylates. It is possible to provide either one or more polymer films using the same or a combination of any of these.

According to one preferred aspect of the present invention there is provided a detergent bar as outlined above wherein the external surface of the bar comprises a polymer film obtained by radiation curing of a radiation-curable resin composition comprising:

(a) about 10% to 60% by weight of a multifunctional (meth)acrylate monomer having a molecular weight of between 170 to 1000 and containing at least two polymerizable unsaturated groups per molecule, (b) about 5% to 60% by weight of oligomer having a molecular weight in the range of 500 to 10,000 and containing any one or a mixture of epoxy (meth)acrylate, aliphatic/aromatic urethane (meth)acrylate, polyester (meth)acrylate, butadiene (meth)acrylate, butadiene PU (meth)acrylate and (meth)acrylic resin, silicone acrylate and (c) a photopolymerisation initiator and/or sensitiser.

For the purposes of this invention the term "(meth) acrylate" is used to denote acrylate and methacrylate and combinations thereof.

According to another preferred aspect of the invention there is provided a detergent bar wherein the external surface of the bar comprises at least one polymer film obtained by radiation curing of a radiation-curable resin composition comprising:

(a) at least an epoxy functional silicone polymer, and (b) a cationic photoinitiator.

According to a further preferred aspect of the present invention there is provided a detergent bar wherein the external surface of the bar comprises at least one polymer film obtained by radiation curing of a radiation-curable resin composition comprising:

(a) at least one cycloaliphatic epoxy resin, and (b) cationic photoinitiator such as aryl sulphonium or iodonium salt.

According to an essential aspect of the invention the detergent bar is provided with a water resistant polymer coating that is preferably substantially insoluble in water and formed from a radiation-curable resin composition. The said radiation-curable resins could be formulated using cationic or free-radical curing systems. The former can be based on cycloaliphatic compounds or silicones while the later can be formulated using wide range of acrylates.

"Radiation" in the present invention refers to electromagnetic radiation, preferably with a wavelength shorter than visible light i.e. Nearer or far ultra-violet (UV), Röntgen or gamma radiation or to particle radiation. The preferred electromagnetic radiation is UV light and the preferred particle radiation is electron beam radiation.

UV-Curable Formulations:

In accordance with a preferred embodiment of this invention, the external surface of the said detergent bar is coated with UV cured polymer. In general UV curing methods involve photo-polymerisation and can be selected from one of two main categories: 1) free radical polymerisation of (meth)acrylate functionalised resins and 2) cationic polymerisation of epoxy resins. Both are well known and well documented in the art. (Meth)acrylate functionalised resins generally comprise (meth)acrylate-functional oligomers and monomers combined with a photoinitiator to bring about UV curing. Cationic systems tend to be based on cycloaliphatic epoxides and a photoinitiator which decomposes to generate strong acid on exposure to UV radiation. The strong acid causes a rapid ring opening of epoxide moiety in monomers to form a reactive cationic species that attacks and open up the next epoxide monomer. A general description of these systems can be found in Radiation Curing in Polymer Science and Technology, Vol. 1: Fundamentals in Methods, Edited by J P Fouassier and J E Rabek, Published by Elsevier Applied Science (1993) and in N. S. Allen, M. A. Johnson, P. Oldring (ed.) and M. S. Salim, Chemistry & Technology of UV&EB-Curing Formulations for Coatings, Inks & Paints, Vol. 2, SITA Technology, London 1991. UV curable formulations can also comprise a hybrid system that involves a combination of cationic as well as free radical mechanisms under UV light.

Cationic UV Curable Formulations:

UV curable cationic compositions typically involve a combination of cationic initiator and epoxy resins such as the cycloaliphatic ones. Multifunctional hydroxy compounds like polyols may be added to enhance curing speeds. Cationic photoinitiators may consist of onium, ferrocenium or diazonium salts which generate strong acids on exposure to UV radiation. Typical salts used as initiators are triarylsulfonium hexafluoroantimonate and diphenyliodium hexafluorophosphate. One such commercially available initiator is sold by UCB Chemicals, Inc under the name Uvacure™ 1590. It is a mixture of triarylsulphonium hexafluorophosphate in a copolymerizable solvent propylene carbonate.

Generally, epoxy resins and monomers useful in preparing the UV cured polymer coatings of the invention are organic compounds having at least one oxirane ring that is polymerizable by a ring opening reaction. Such materials, broadly called epoxides, include both monomeric and polymeric epoxides and can be aliphatic, cycloaliphatic, heterocyclic, or aromatic or combinations thereof. They can be liquid or solid or blends thereof. Useful epoxy resins include the cycloaliphatic ones such as those which contain cyclohexene oxide groups e.g. epoxycyclohexane carboxylates. One such commercially available epoxide resins is Uvacure™ 1500 sold by UCB Chemicals, Inc. It is a very pure grade of 3,4-epoxycyclohexylmethyl-3,4-epoxycyclohexane carboxylate.

Epoxide functional silicone polymers are also amenable to cationic cure. A typical composition includes: (a) a pre-crosslinked epoxy functional dialkylepoxy-chain-stopped polydialkyl-alkylepoxysiloxane copolymer fluid, and (b) a bis-aryl iodonium salt which is effective for catalysing an ultraviolet light initiated cure reaction of the polydiorganosiloxane silicone intermediate fluid. A typical example is commercially available epoxy functional linear polydimethyl siloxane copolymer sold under the name of UV9400™ by GE Bayer Silicones which can be catalytically crosslinked by UV9380c™, a commercially available silicone catalyst from GE Silicones which contains iodonium hexafluoroantimonate.

Free Radical UV Curable Formulations:

Monomers:

In UV curable composition according to the invention a multifunctional acrylate monomer containing at least two polymerisable unsaturated groups per molecule is combined with a suitable oligomer to provide a coating film having excellent mechanical and water barrier properties to withstand the usual conditions during the use of the detergent bars. Typical multifunctional acrylate monomers are of the reactive diluent type, have a molecular weight of about 170 to about 1000. Specific examples of the multifunctional monomers which can be used in the present invention include trimethylolpropane triacrylate (TMPTA), pentaerythritol triacrylate, pentaerythritol tetraacrylate, pentaglycerol triacrylate, triacryloxyethyloxyhydride mellitate, glycerol propoxylate triacrylate (GPTA), hexanediol diacrylate (HDODA), triethylene glycol diacrylate (TEGDA) and/or its alkoxylated derivative, tripropyleneglycol diacrylate (TPGDA) and/or its alkoxylated derivative, neopentylglycoldiacrylate (NPGDA) and/or its alkoxylated derivative, tetraacryyoxyethyloxyhydride pyromellitate, dipentaerythritol (tri-, tetra-, penta-, or hexa-)acrylate or the like. These monomers can be used alone or in combinations of two or more. The preferred coating composition includes these multifunctional acrylates in an amount of about 10% to about 60% by weight, with the range of about 20% to about 50% being more preferred.

Oligomers:

Useful oligomers are the acrylic oligomers which have an all-carbon backbone that is formed by the polymerisation of ethylenic unsaturation of acrylate and other monomers. Other useful oligomers are acrylated or methacrylated urethane, acrylated polyester, acrylated epoxy or acrylated polyether whose polymeric backbones have oxygen and nitrogen of the urethane [—OC(O)NH—], oxygen of the ester [—C(O)O—], or oxygen of the epoxy or ether [—O—]. The acrylic oligomers have an average molecular weight of about 500 to about 10,000 and preferably 500–4,000. Acrylic oligomers are typically copolymers of ethylenically unsaturated monomers such as styrene, glutaric acid, maleic acid and acrylic acid esters that have residual photopolymerisable acrylic unsaturation.

A preferred example of epoxy acrylate oligomer commercially available from UCB Chemicals, Inc. has an average molecular weight of about 500, diluted to 25% with TPGDA and is sold under the name Ebecryl™ 605. The oligomer/monomer blend provides a UV-cured film which is said by the manufacturer to have a tensile strength of 13900 psi, a tensile elongation of 7% and a glass transition temperature of 67° C. This oligomer is fast curing, provides high gloss and excellent water resistance.

A preferred example of polyester acrylate oligomer is commercially available from UCB Chemicals, Inc. under the name Ebecryl™ 450 and has an average molecular weight of about 1500. This is a fast curing fatty acid modified polyester hexa acrylate with excellent wetting property. The resulting UV-cured film is said by the manufacturer to have a tensile strength of 4300 psi, a tensile elongation of 4% and a glass transition temperature of 17° C.

A preferred example of an acrylic resin oligomer commercially available from UCB Chemicals, Inc. under the name Ebecryl™ 745. This oligomer is diluted to 46% with a monomer such as TPGDA. The resulting UV-cured film is said by the manufacturer to have a tensile strength of 1900 psi, a tensile elongation of 52% and a glass transition temperature of 30° C. The film has excellent mechanical properties and improved adhesion to detergent substrates.

Examples of polyurethane acrylate oligomers are generally synthesised by reacting a diisocyanate with polyester or polyether polyol to yield an isocyanate terminated urethane. Subsequently, hydroxy terminated acrylates are reacted with the terminal isocyanate groups. The urethane acrylate oligomers can be of aliphatic or aromatic nature, depending on the choice of diisocyanate. Typically, polymer films based on aliphatic urethane acrylates are more stable and provide higher flexibility. In contrast, aromatic urethane acrylates are harder and provide chemical resistance. Similarly, the polyol backbone plays an important role in determining the curing rate as well as the properties of the cured film. Flexibility of the polymer film, for example is a function of polyol molecular weight and functionality, with higher molecular weight diols providing higher flexibility.

One such commercially available aliphatic urethane acrylate is sold under the name EB 244™ by UCB Chemicals, Inc. This oligomer is diluted 10% with a monomer such as HDODA. The resulting UV-cured film is said by the manufacturer to have a tensile strength of 3700 psi, a tensile elongation of 60%

Photoinitiator

In the coating composition, a photo-polymerisation initiator is used to allow curing of the above coating film forming components in the resin composition. The preferred amount in the coating resin composition is 2–10% wt of the resin composition, and more preferably 4–8% wt. If the content of the photo polymerisation initiator is less than 2% the hardening of the coating film by UV rays will be insufficient, and it is not preferred for the initiator content to exceed 10% wt, because the weatherability of the coating film will decrease, and the cured film may be subject to colouring.

Suitable free radical photo-polymerisation initiators are: acetophenone type compounds, benzoin ether type compounds, benzophenone type compounds, phosphine oxide type compounds, organic peroxides and the like. Specific examples of these include:

i) carbonyl compounds such as benzoin, benzoin methyl ether, benzoin ethyl ether, benzoin isopropyl ether, acetoin, butyroin, toluoin, benzil, benzophenone, p-methoxy-benzophenone, diethoxyacetophenone, α,α-dimethoxy-α-phenylacetophenone, methylphenyl glyoxylate, ethylphenyl glyoxylate, 4,4'-bis(dimethylamino)benzophenone, 2-hydroxy-2-methyl-1-phenylpropane-1-on; 1-hydroxy-cyclohexyl phenyl ketone;

ii) sulfur compounds such as tetramethylthiuram monosulfide, tetramethylthiuram disulfide;

iii) azo compounds such as azobisisobutyronitrile, and 2,2'-azobis(2,4-dimethylvaleronitrile), iv) peroxide compounds such as benzoyl peroxide, ditertiar-butyl peroxide.

In order to promote rapid curing in UV light, mono- or di-functional amine synergists are commonly used in conjunction with the photoinitiators such as alkyl/aryl ketones or other hydrogen abstracting type initiators. Acrylated amine synergists promote curing by generation of free radicals as well as by overcoming oxygen inhibition at the coating surface. In the later case, an amine radical reacts with free oxygen which reduces the amount of oxygen available at the coating surface for polymerisation termination. This not only depletes oxygen but also produces another free radical amine. In the cured films these acrylated amines become part of the cured polymer. Commercially available acrylated amines are Ebecryl™ P115 and Ebecryl™ 7100 sold by UCB Chemicals, Inc.

The coating resin composition can also include other conventional additives. For instance, it can contain polymeric or silicone coating surface improvers, flow improvers, dyes, pigments, antioxidants, flatting agents (e.g. wax-coated or non-wax-coated silica or other inorganic materials), etc. In more preferred compositions, flow improver is included at a level of about 0.3–3%, and in one especially preferred composition, the flow improver Tego 2100, available from Goldschmidt, Germany has been included.

The resin composition also optionally includes a suitable inert solvent. Representative solvents include: ester solvents, e.g. ethyl acetate, butyl acetate; ketone solvents, e.g. acetone, methylisobutylketone and methylethylketone; alcohols, e.g. butyl alcohol; and aromatic solvents, e.g. toluene, xylene. The amount of solvent included will vary in accordance with the particular application at hand. For instance, for spray applications, higher levels of solvent will typically be included, while for roll applications, lower levels of inert solvent, if any, will be employed. In any event, the inert solvent will constitute from 0% to about 95% by weight of the entire coating composition, and in preferred coating compositions 20–80%, more preferred 40–60%.

Accordingly, and as another embodiment of the invention, a process for the manufacture of a detergent bar according to the invention is provided which comprises the steps of:

(a) forming a detergent composition into a detergent bar, (b) coating the bar with a photo curable resin, and, (c) exposing the said bar to UV/EB radiation.

Forming the detergent bar may be done by any process known in the art for manufacturing solid shaped detergent products such as extruding, plodding or casting. The first process is conventionally used for making laundry bars and hard surface cleaning bars, particularly hand dishwash bars. The second and third processes are conventionally used for making detergent bars such as soap tablets for personal cleansing.

As to its use, the coating resin composition can be applied by any conventional coating method as known in the art. The method of applying the resin composition of the present invention is not limited, and commonly known coating methods such as brush coating, flow coating, immersion or dip coating and spray coating can be used, as well as any other method able to produce a plurality of fine resin droplets and allowing them to settle on the surfaces of the detergent bar to form a smooth film. When coating, it is preferable to adjust the viscosity of the coating resin composition using an organic solvent, from the point of view of improving the operability, smoothness and uniformity of the coating film, and the adhesion of the cured coating film to the bar body. Examples of preferred organic solvents were given above and include ethanol, isopropanol, butanol, toluene, xylene, acetone, methylethyl-ketone, ethyl acetate, butyl acetate and the like. The composition can be applied directly to the bar surface or be applied over another previously cured (e.g. paints or primers) or uncured (e.g. in the case of tie coats) coating films. The material is advantageously used at about 5 micron to about 100 micron of cured film thickness, with a more preferred cured film thickness of 20–50 micron. The preferred thickness will provide sufficient film continuity, avoid surface sagging, and promote a satisfactory cure. Once applied, the coating resin composition can be cured by irradiation preferably with ultraviolet rays, as is known to those skilled in the art. In this regard, the irradiation is continued until curing is complete, with preferred exposure times typically being less than 10 seconds. An ultraviolet light source having a wavelength range of between about 180 nm and 450 nm is preferred. For example, sunlight, mercury lamps, arc lamps, xenon lamps, gallium lamps, and the like may be used, but medium pressure, high pressure or ultrahigh pressure mercury lamps provide particularly advantageous rapid cure. A medium to high pressure mercury lamp having an intensity of about 70 W/inch to 1000 W/inch is preferred. These preferred curing processes have provided good thorough cure, and have ensured advantageous coatings that resist premature yellowing and demonstrate desirable thermal crack resistance.

The coating is applied to at least one side of the detergent bar, more preferably to more than one side. However, preferably one side of the bar remains largely uncoated.

Most preferably this side which remains uncoated is a side opposite a side on which the bar can easily be laid flat.

Detergent Actives:

The composition according to the invention comprise detergent actives that may be soap or non-soap surfactants and generally chosen from anionic, nonionic, cationic and zwitterionic/amphoteric surfactants or mixtures thereof. Suitable examples of detergent-actives are surface-active agents given in the well-known textbooks: "Surface Active Agents" Vol. 1, by Schwartz & Perry, Interscience 1949; "Surface Active Agents" Vol. 2 by Schwartz, Perry & Berch, Interscience 1958; the current edition of "McCutcheon's Emulsifiers and Detergents" published by Manufacturing Confectioners Company; "Tenside-Taschenbuch", H. Stache, 2nd Edn., Carl Hauser Verlag, 1981.

The total amount of detergent actives to be employed in detergent compositions of the invention will preferably be from 5–30% by weight of the composition for bars intended to be used for laundry or hard surface cleaning.

For bars intended for personal cleansing the total amount of detergent active may usefully be up to 85% and may comprise a large proportion, or even consist exclusively, of fatty acid soap.

Abrasives:

Particularly detergent bars intended for hard surface cleaning, more particularly for cleaning dishes and cooking utensils, often comprise solid particulate abrasive. Suitable abrasives can be selected from, particulate zeolites, calcites, dolomites, feldspar, silicas, silicates, other carbonates, aluminas, bicarbonates, borates, sulphates and polymeric materials such as polyethylene. There can be an abrasive system with more than a single type of abrasive to achieve balanced abrasive properties. It has been shown that combinations of abrasives of different hardness in a formulation provide significant benefits in some of the user properties. Abrasive may be included in the coating to assist in its initial removal.

Detergency Builders:

Detergent bars intended for cleaning laundry or for cleaning hard surfaces may contain detergency builders as optional ingredients. The detergency builders/alkaline buffer salts used in such detergent compositions are preferably inorganic and suitable builders include, for example, alkali metal aluminosilicates (zeolites), sodium carbonate, sodium tripolyphosphate (STPP), tetrasodium pyrophosphate (TSPP), and combinations of these. Builders/alkaline buffer salts are suitably used in an amount ranging from 2 to 15% by wt, preferably from 5 to 10% wt.

Other Optional Ingredients:

Other ingredients such as solvents, amines, perfumes, colouring agents, flourescers and enzymes are known in the art as optional but useful components of detergent bars. They can also be used in the detergent bars according to the invention, for example in an amount up to 10 wt %. The choice of which ingredients to add will depend on the intended end use of the bars, as will be readily apparent to those skilled in the art. Fillers and structurants, well known in the art, may also be present in the bars according to the invention, in amounts known to give required hardness, rigidity and resistance to wear to the bars.

EXAMPLES

Example 1

Detergent Compositions:

Detergent compositions useful for washing dishes and cooking utensils, for laundry washing and for personal cleansing having formulations as described in Table 1 were used for the demonstration of the invention. These were prepared by mixing the ingredients and extruding them in a conventional manner.

TABLE 1

Formulation for dish washing

| Ingredients | Composition (% wt) |
|---|---|
| Sodium LAS | 14 |
| Sodium carbonate | 12 |
| Sodium tripolyphosphate | 2 |
| Inorganic particulates dolomite/China clay | 59 |
| Magnesium sulphate | 0.5 |
| Alkaline silicate | 3 |
| Water | To 100 |

TABLE 2

Formulation for personal cleansing

| Ingredients | Composition (% wt) |
|---|---|
| Soap | 82.1 |
| Perfume (25905 M4, HLRC) | 1.5 |
| Glycerol | 6.0 |
| Tetrasodium EDTA | 0.014 |
| Ethane 1-Hydroxy-1,1-Diphosphonic Acid (EHDP) | 0.05 |
| Water, Minors | To 100 |

TABLE 3

Formulation for laundry washing

| Ingredients | Composition (% wt) |
|---|---|
| Soap | 55 |
| Sodium LAS | 3 |
| Soda | 1 |
| Salt | 0.5 |
| Moisture | 22 |
| Calcite | balance |

Example 2

Bar Coated with a Non Photo-Cured Film:

Detergent bars prepared according to Example 1 were coated with 25% poly(methyl methacrylate) (PMMA) polymer dissolved in chloroform. The coating was applied using a brush and was allowed to dry at 45° C. for 12 hours. The bars became tack-free after nearly 30 minutes.

These bars are outside the invention.

Examples 3–6

Bars Coated with a Photo-Curable Resin Formulation:

Bars prepared according to Example 1 were coated with different photo-curable resin formulations and cured using a 300 watts/inch medium pressure mercury vapour lamp as the UV source for less than one second. In examples 3 to 6 different resin formulations according to the invention were used as outlined in Table 4.

Examples 3 and 4

Bars Coated with Photo-Curable Acrylate Compositions:

Example 3

A UV curable composition based on the formulation presented in table 4 was prepared in a beaker and the same was applied onto a detergent bar using a brush. The application ensured uniform spreading of the coating on to five faces of the bar which was lying on the sixth face. Propoxylated NPGDA was used as a monomer, while commercially available epoxyacrylate Ebecryl™ 605 from UCB chemicals was used as an oligomer. A combination of benzophenone and Duracure 1173 (marketed by CIBA Fine Chemicals) was used as photoinitiator. In addition, amine synergists Ebecryl™ P115 and Ebecryl™ 7100 were also used in this formulation. Flow additive Ebecryl™ 350, an acrylated silicone from UCB Chemicals, was also used to provide superior substrate wetting.

Example 4

A UV curable composition based on the formulation presented in table 4 was prepared in a beaker and the same was applied onto a detergent bar using a brush. This formulation is similar to example 3 except that a preferred combination of oligomers were used to enhance film properties. In particular, acrylic resin (DM-55), polyester acrylate (Ebecryl™ 450), polyurethane acrylate (Ebecryl™ 220), butadiene polyurethane acrylate (CN 971 A80) and aromatic polyurethane acrylate (CN302) were used. Most of the other ingredients in this formulation are the same as example 3.

Example 5

Bar Coated with a Photo Curable Silicone Composition:

A photocurable silicone composition, according to the formulation presented in Table 4, was prepared using UV9400, an epoxy-functional linear polydimethylsiloxane coating available from GE Silicones, and UV9380c, a silicone catalyst available from GE Silicones which contains iodonium hexafluoroantimonate.

The mixture was prepared and coated onto bars using a brush.

Example 6

Bar Coated with a Photo Curable Cationic Composition:

The cationic resin composition, according to the formulation presented in Table 4, was based on polymerisation of cycloaliphatic epoxy resins. The base of this composition was Uvacure 1500, an epoxy resin available from UCB chemicals and it also contains 3,4-epoxycyclohexyl-methyl-3,4-epoxycylcohexane carboxylate. In addition, Uvacure 1530 which is an epoxide/aliphatic polyol blend with low molecular weight, was also used to provide superior film resistance and high cure speed. Cationic photo-initiator Uvacure 1590, which contains a mixture of triarylsulfonium hexafluorophosphate salts in a co-polymerizable solvent and propylene carbonate was used in this formulation. SilWet® L-7602, a wetting agent from Union Carbide Corporation, was used in this formulation to enhance substrate wettability.

TABLE 4

| Resin components | Ex. 3 | Ex. 4 | Ex. 5 | Ex. 6 |
|---|---|---|---|---|
| PO - NPGDA | 40 | 41 | — | — |
| Ebecryl ® 605 | 40 | 20 | — | — |
| Ebecryl ® 450 | — | 1.5 | — | — |
| CN 971 A80* | — | 5 | — | — |
| CN 302* | — | 5 | — | — |
| Ebecryl ® 220 | — | 2 | — | — |
| DM-55** | — | 5.5 | — | — |
| Duracure ® 1173 | 2 | 2 | — | — |
| Benzophenone | 5 | 5 | — | — |
| Ebecryl ® 7100 | 5 | 5 | — | — |
| Ebecryl ® P115 | 7 | 7 | — | — |
| Ebecryl ® 350 | 1 | 1 | — | — |
| Uvacure ® 1500 | — | — | — | 57 |
| Uvacure ® 1530 | — | — | — | 37.5 |
| Uvacure ® 1590 | — | — | — | 5 |
| Silwet ® L-7602 | — | — | — | 0.5 |
| UV 9400*** | — | — | 96 | — |
| UV 9380c*** | — | — | 4 | — |

*Ex Sartomer
**Ex Rohm & Haas Co.
***Ex GE Silicones

Determination of the Water Barrier Properties:

The coatings of the UV cured coated bars (Examples 3 to 6), the non UV cured coated bars (Example 2) and the control uncoated bars (Example 1), all according to Table 1, were analysed for their water barrier properties during in-use conditions. In order to test the same, the coated and the control bars were placed in a pool of water and the active detergent (AD) dissolution and physical condition of the bars were monitored as a function of time. Typically, data were collected after 2 hr and 24 hr and the coatings are ranked based on these AD dissolution rate. Typically, bars with superior water barrier properties result in nil or negligible amount of AD in the water pool. The results obtained for formulations presented in examples 3 through 6 are shown in Table 5.

TABLE 5

| | | Barrier Properties (AD in mg/10 ml) | |
|---|---|---|---|
| Examples | Coating description | 2 hrs. | 24 hrs. |
| Example 1 | Control bar without coating | 90 | 110 |
| Example 2 | Bar coated with a non photo-curable polymer. | 55 | 104 |
| Example 3 | Bar coated with UV curable acrylate coating | 0 | 10 |
| Example 4 | Bar with preferred UV curable acrylate coating | 0 | 2 |
| Example 5 | Bar coated with UV curable silicone coating | 0 | 8 |
| Example 6 | Bar coated with UV curable cationic coating | 0 | 20 |

Determination of Curing Time and Gloss:

The time for curing was monitored during the process of manufacture of the bars. The gloss was measured using a gloss meter (Trigloss meter M, Scheen Instruments, UK). The data on curing time and gloss for Examples 3 through 6 are presented in Table 6.

TABLE 6

| Examples | Curing Time | Gloss (85°) |
|---|---|---|
| Example 1 | NA | 3 |
| Example 2 | 30 min | 25 |
| Example 3 | <1 Sec | 78 |
| Example 4 | <1 Sec | 75 |
| Example 5 | <1 Sec | 45 |
| Example 6 | <5 Sec | 70 |

The data presented show that the films according to the invention examples 3–6 have very good barrier properties as indicated by the amount of active detergent dissolved and leached out into the water and the time taken for curing is extremely low. The gloss is also highly superior as compared to bars without the coat and those coated with non-photo curable polymers.

What is claimed is:

1. A process for the manufacture of a detergent bar comprising 0.5 to 95% by weight detergent active and 0 to 90% by weight of inorganic particulates and/or other conventional ingredients, which comprises the steps of:

(a) shaping a detergent composition to form a detergent bar, (b) coating the bar with a photo-curable resin composition, and, (c) exposing the said bar to electromagnetic radiation with a wavelength shorter than visible light or to particle radiation to cure the resin composition to a polymer film.

2. A process according to claim 1 wherein the shaping of the detergent composition into a bar is done by extruding, plodding or casting of the composition.

3. A process according to claim 1 wherein the electromagnetic radiation is UV light.

4. A process according to claim 1 wherein the resin composition is applied by brush-, flow-, immersion- or spray coating.

* * * * *